United States Patent [19]

Schantz et al.

[11] Patent Number: 4,995,650

[45] Date of Patent: Feb. 26, 1991

[54] BIMETAL OPERATED LID SWITCH AND LOCK FOR APPLIANCES

[75] Inventors: Spencer Schantz, Dousman; Ronald J. Janz, Milwaukee; Gary Christiansen, Wauwatosa; Steven Sager, Greendale, all of Wis.

[73] Assignee: U.S. Controls Corp., New Berlin, Wis.

[21] Appl. No.: 316,859

[22] Filed: Feb. 28, 1989

[51] Int. Cl.[5] ..... F05B 17/22

[52] U.S. Cl. ..... 292/201; 792/DIG. 66; 792/DIG. 69; 68/12 R

[58] Field of Search ..... 292/DIG. 69, DIG. 66, 292/201; 68/12 R

[56] References Cited

U.S. PATENT DOCUMENTS

| | | | |
|---|---|---|---|
| 4,032,180 | 6/1977 | Pohl | 292/DIG. 69 |
| 4,074,545 | 2/1978 | Case | 292/DIG. 69 X |
| 4,179,907 | 12/1979 | Schantz | 68/12 R |
| 4,286,811 | 9/1981 | Schantz | 292/DIG. 69 |
| 4,620,735 | 11/1986 | Heyoner | 292/DIG. 69 X |
| 4,664,429 | 5/1987 | Notaro et al. | 292/DIG. 69 X |
| 4,718,705 | 1/1988 | Case | 292/DIG. 69 X |

FOREIGN PATENT DOCUMENTS

| | | | |
|---|---|---|---|
| 2254595 | 7/1973 | Fed. Rep. of Germany | 292/DIG. 69 |
| 2711891 | 9/1978 | Fed. Rep. of Germany | 292/DIG. 66 |

*Primary Examiner*—Eric K. Nicholson

*Attorney, Agent, or Firm*—Fuller, Ryan & Hohenfeldt

[57] ABSTRACT

An interlock device for preventing access to a moving part of an appliance, such as the spin drying basket of a washing machine, until the basket has coasted to a stop during a spin drying cycle. A switch lever is actuated by closing the closure lid of the machine. This closes a switch in series with a bimetal and the basket drive motor. Motor current heats the bimetal which deflects and drives a dual purpose actuator which drives a lid locking lever to engage a latch and also closes a switch connected in shunt with the bimetal so as to bypass the bimetal momentarily and then conduct alternately through it so it does not overheat. The switch and lid lock assembly features a dual purpose actuator, special seal elements for the actuator shaft, a combination torsion and compression spring to put pressure on the seal elements and resiliently position the locking lever, actuator shaft bearings that slide in place, bendable tabs for prepositioning the bimetal to correct for variations in straightness, and a binding free connection between bimetal and actuator.

17 Claims, 3 Drawing Sheets

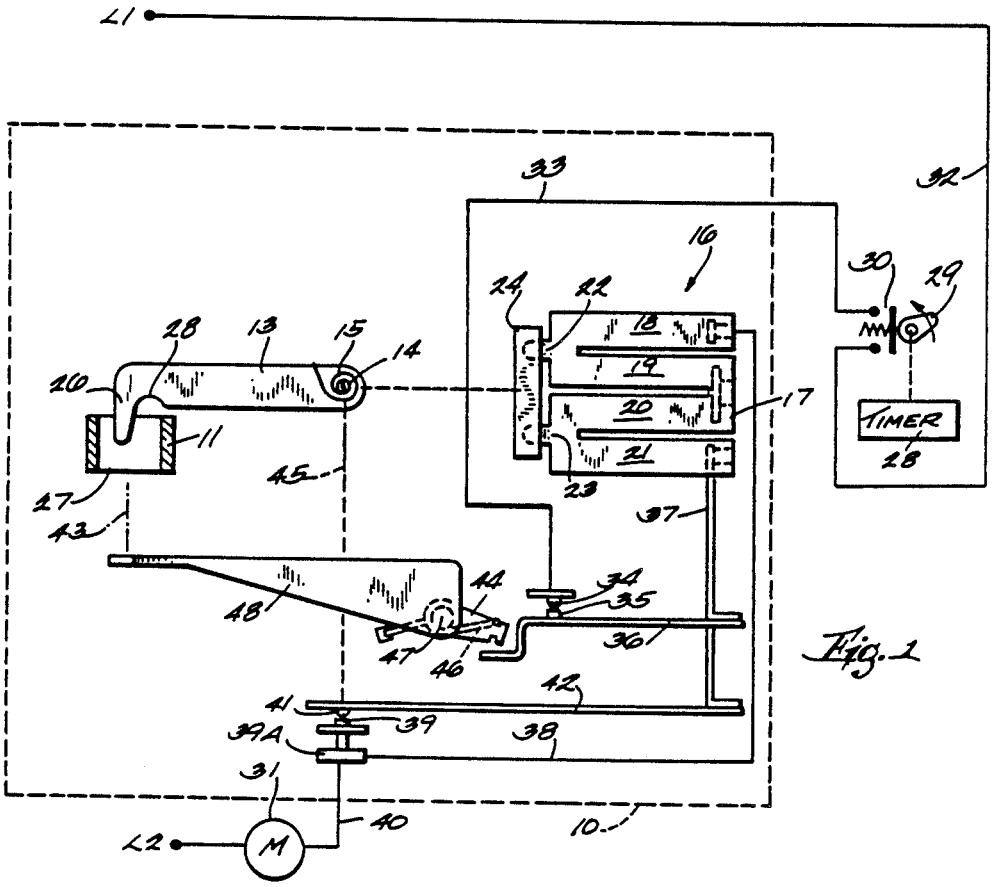
Fig. 1
Fig. 8
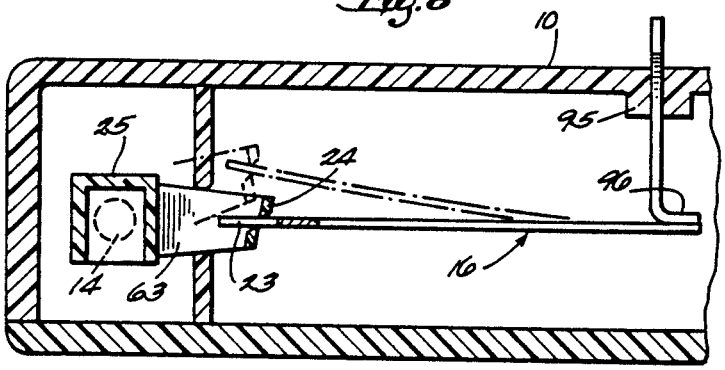
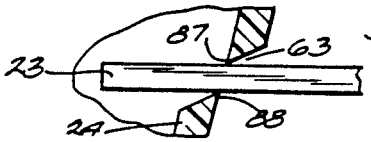
Fig. 9
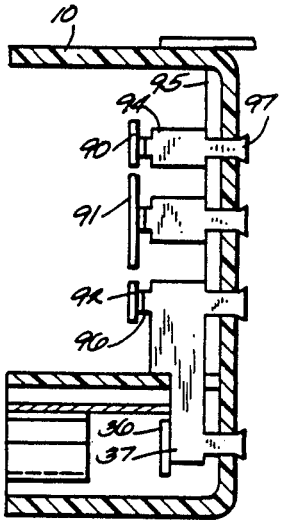
Fig. 5

BIMETAL OPERATED LID SWITCH AND LOCK FOR APPLIANCES

BACKGROUND OF THE INVENTION

The new safety interlock device disclosed herein is for use in appliances such as household washing machines and dryers for maintaining the access door locked at any time that a motor driven component such as the spin dry basket of a washing machine is being driven or is coasting to a stop. For centrifugal drying the basket is rotated at high speed so there is chance for a person to be injured if the basket can be accessed while still rotating U.S. Pat. No. 4,286,811, describes a bimetal actuated locking device and switch which has some of the basic features of the improved switch design described herein. It is a unitary device including a switch and a pivotal switch operating arm mounted on a base. The switch operating arm is biased rotationally in one direction. When the lid of an appliance is closed, the operating arm is rotated and a circuit is completed through a bimetal element in a device and through the motor that drives the basket of the washing machine during the spin dry phase of the machine operating cycle. The motor is energized provided the timer switch customarily found in washing machines has otherwise closed the circuit through the motor to enable it to be run during the spin drying phase.

When the lid is closed, the bimetal heats and deflects and thereby causes a latch arm to swing into engagement or locking relation with a latch element. This locks the lid closed. The lid remains latched until the motor has been de-energized long enough for the bimetal element to cool and deflect oppositely. The resulting delay period precludes access to the basket or other moving component of the machine until the basket has coasted to a complete stop.

One of the problems with conventional bimetal-operated appliance locks is that when a motor is heavily loaded because of a large load in the basket of the washing machine during its drying cycle, heavy electric current flows through the bimetal and exceeds its rating. In other words, the bimetal deflects excessively which can result in permanent distortion and loss of calibration. It can also cause degradation of plastic parts in the switch and lock assembly.

One solution to the excessive heating and excessive deflection of the bimetal has been invented by Richard Case, assignor to White Consolidated Industries. His solution is to connect shunting contacts in parallel with the bimetal blade and cause the shunting contacts to close when the blade travel reaches a desired excursion. Closure of the shunt switch causes the bimetal to cool momentarily until the contacts open thereby limiting the bimetal temperature through contact cycling. A problem associated with this concept is that any restriction of the lock lever can prevent sufficient excursion of the bimetal to close the shunting contacts, thereby permitting the blade to overheat anyway.

The bimetal switch actuating member used in safety lock switches of the kind under discussion, even if they are from the same manufacturing batch, exhibit variances in straightness. In prior safety lock switches, no means have been provided for compensating the variances in straightness which means that there is no certainty that the bimetal member will be in the desired neutral position when it is cold. Combination lid lock and switching devices are installed in appliances such as washing machines where they are vulnerable to being splashed with water. In mechanical lock/switches, there must be a shaft extending from the inside to the outside of the switch housing to swing the locking lever. This requires some kind of seal about the shaft. Conventional seals have imposed a substantial frictional drag on the shaft which can propagate a restraining force on the bimetal. A seal that imposes little drag on the operating shaft would be desirable because the shaft is operated by a force derived from the bimetal and this is a low-level force. A correlative problem is to mount the shaft in bearings that will contribute toward achieving a good splashproof seal between the inside and outside of the switch housing and will impose minimal frictional drag on the operating shaft.

SUMMARY OF THE INVENTION

An objective of the present invention is to provide a bimetal-operated safety switch and lock for appliances whose parts are so designed and related that it will be free of mechanical and electrical restraints under all operating conditions.

An important feature of the new lock/switch design resides in providing for operation of the shunt contact and the locking lever with a single actuator that is driven by the deflecting bimetal element.

Another feature is to provide movable parts, such as the lever that locks the lid, with a lost motion capability so that no part that is suppose to move can be blocked to prevent operation of the shunt switch. In particular, the invention features a resilient coupling between the locking lever and the bimetal operated shunt switch contacts. In addition, the lock lever is spring loaded in the direction of its rotational axis to allow it to flex upwardly against the top of the washing machine when the lid is lifted while the lever is still rotated to its locking or latching position A further feature of the new lock/switch design is to mount the bimetal in a fashion that permits adjusting it to compensate for manufacturing tolerance.

How the foregoing features and other features and objectives of the invention are achieved will be evident in the ensuing, more detailed description of a preferred embodiment of the invention which will now be set forth in reference to the drawings.

DESCRIPTION OF THE DRAWINGS

FIG. 1 is a diagram of a circuit in a spin dry washing machine which employs the new bimetal operated combination switch and lid lock;

FIG. 5 is a vertical section taken on a line corresponding to 5—5 in FIG. 4;

FIG. 8 is an isolated view of the bimetal used in the device and a part of the lock lever actuator which is shown in inactive and activated positions;

FIG. 9 is an isolated magnified view of a part that is shown in FIG. 8 to reveal how the free end of the bimetal reacts with the arm which it operates;

DESCRIPTION OF A PREFERRED EMBODIMENT

Figure 2:
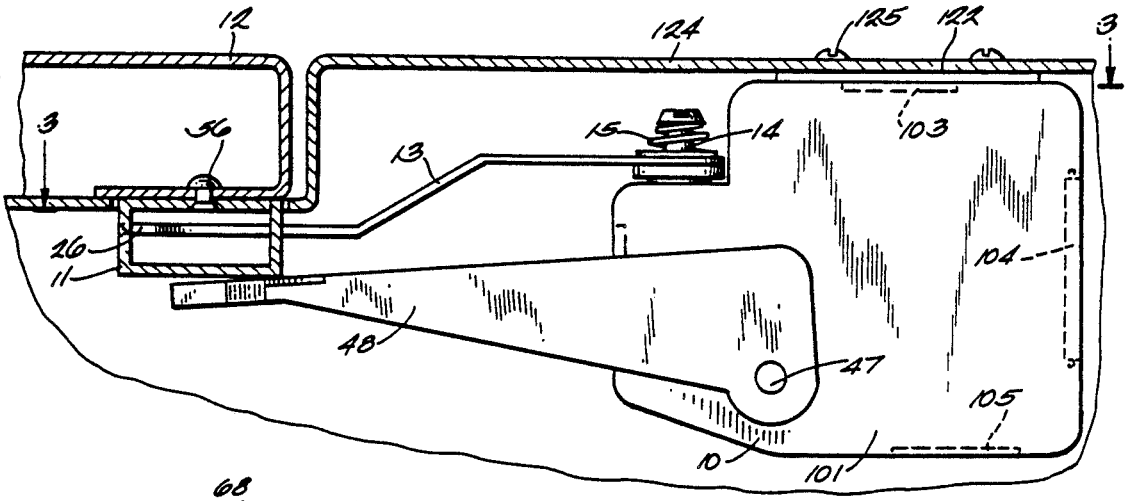
FIG. 2 is a side elevation view of the switch and lock assembly installed in an appliance such as a washing machine and showing part of the housing and lid of the machine in section.

Attention is invited to FIG. 1 for a general discussion of the main parts of the new lid lock/switch device and the way the parts are arranged in the circuit of a spin dry washing machine, for instance. The parts comprising the lock/switch assembly and the parts on the machine which cooperate with the assembly are contained within the dashed line rectangle marked 10 which also symbolizes the casing or housing of the device. There is a latch element 11 which is like a closed loop or an eye that is fixedly mounted to lid 12 of the appliance which is shown in FIG. 2. The lock lever 13 is shown diagramatically in FIG. 1. It is yieldably fixed on a journaled actuator shaft 14 by means of a spring 15 which serves the double purpose of applying biasing torque on lock lever 13 and applying an axial force on the lock level which force is further transmitted to a seal as will be described in greater detail later. Actuator shaft 14 is part of the unitary assembly and is outside of the housing 10 which is molded of plastic and shown in FIGS. 2 and 3, for example.

A serpentine-shaped bimetal is depicted in FIG. 1 and is indicated generally by the reference numeral 16. The right ends 17 of the bimetal element shown schematically in FIG. 1 are supported in cantilever fashion to facilitate making adjustments for correcting some bimetals for a lack of straightness which might prevent a bimetal from being in a predetermined neutral position when the bimetal is cold. The manner in which the bimetal 16 is mounted for adjustment will be discussed in greater detail later. The bimetal has four legs 18–21 each two of which terminate in prongs 22 and 23 for engaging with the cross bar of a lock lever shaft actuator 24 only a part of which is represented in FIG. 1. Construction of the actuator will be elaborated later. For the time being, it is sufficient to observe that bimetal 16 conducts the current which flows through the appliance motor 31 that drives the perforated basket, not shown, rotationally to accomplish centrifugal drying of the fabrics in the machine basket. When bimetal 16 becomes hot, its left end, as depicted in FIG. 1, deflects downwardly, thus pressing cross bar of the lock lever shaft actuator 24 downwardly. This swings the lock lever 13 counterclockwise as viewed in FIG. 1. A mechanical connection 25 symbolizes the part of the lock lever actuator 24 which applies a force to the lock lever shaft 14 and, hence, to the lock lever 13 for rotating it counterclockwise as depicted so its hooked end 26 will enter the opening 27 of latch element 11 to thereby prohibit opening of the lid 12 until the bimetal cools and deflects back to neutral position as a result of motor 31 current that has been flowing through the bimetal being discontinued. The bimetal deflects back to neutral position and, hence, the hook on lock lever 13 swings out of engagement with the latch loop 11 with sufficient delay so that it is certain that the spin dryer basket will have come to a complete stop.

One mode of switch operation will now be discussed. Assume that timer 28 has reached spin dry cycle time so it drives cam 29 to close contact 30 so as to energize motor 31 and initiate a spin dry cycle. Upon this event, alternating current will flow from line 1 (L1) through a circuit including conductor 32, timer contacts 30, a conductor 33, the stationary noble metal contact 34, a noble metal contact 35 on a flexible metal switch arm 36 which is called a lid operated switch, a conductive support 37, into the bimetal 16 by way of its leg 21, out of the bimetal 16 by way of its leg 18, then through a conductor 38 to a terminal 39*a* and then through a conductor 40 and motor 31 to line 2 (L2). Note, however, that there is a switch that is connected in parallel or shunt with the bimetal element 16. The shunt switch comprises stationary noble metal contact 39 and a movable contact 41 which is mounted to a resilient switch blade 42 which is, in turn, mounted conductor 37. When shunt switch contacts 39 and 41 are closed, it will be evident that conductor 38 will make a connection to one end of the bimetal leg 18 and conductor 37 and blade 42 will make a connection to leg 21 at the other end so that the motor current which would otherwise be conducted through the closed lid operated switch contacts 34 and 35 is diverted through the shunt contacts.

As soon as the appliance lid 12 is closed, the latch loop 11 presses down on the end of a lid operated lever 48 as indicated by the dashed-dot line 43 in FIG. 1. The actual parts of the lid operated safety switch are most easily seen in FIGS. 4 and 7. Closing the lid rocks the lid operated lever 48 so its short arm 44 rocks in a direction away from the springy switch blade 36. This allows lid switch contacts 34 and 35 close so the motor 31 can turn on if the timer contacts 30 are closed. This heats the bimetal 16 which deflects and causes actuator element 24 to apply a torsional force to actuator shaft 14 to thereby cause the hooked lock lever 13 to engage in loop 11 so that the lid 12 of the machine cannot be opened while motor 31 is running. As the bimetal 16 heats, the hook 26 on lock lever 13 begins to penetrate deeper into the latch element 11. When the bimetal gets hot enough to drive the lock lever 13 a certain amount, there is a shunt switch operating lever represented by the dashed line 45 in FIG. 1 which is operated by lock lever shaft 14 and which causes the shunt switch contacts 39 and 41 to close and cause the motor 31 current to be bypassed around the bimetal 16. The bimetal begins to cool and the lock lever 13 begins to swing by a small amount toward its neutral unlocked position. Meanwhile the bimetal is cooling for a moment and the shunt switch contacts 39 and 41 are opened at which time the bimetal begins to heat again. This cyclic operation of the shunt switch occurs at rather high frequency but lock lever 13 is never permitted to unlatch as long as the circuit to the motor is completed by way of timer contacts 30 being closed. There is no sparking between shunt switch contact points 39 and 41 due to their opening while conducting motor 31 current because as they begin to separate, current is immediately diverted through the bimetal again. In a typical case, the voltage drop across open shunt switch contact points 39 and 41 is about 1 volt. This small voltage is not conducive to causing arcing between contacts when they are open. For this reason contact 44 is conical in shape and contact 39 is flat. Both are gold plate over silver.

Figure 7:
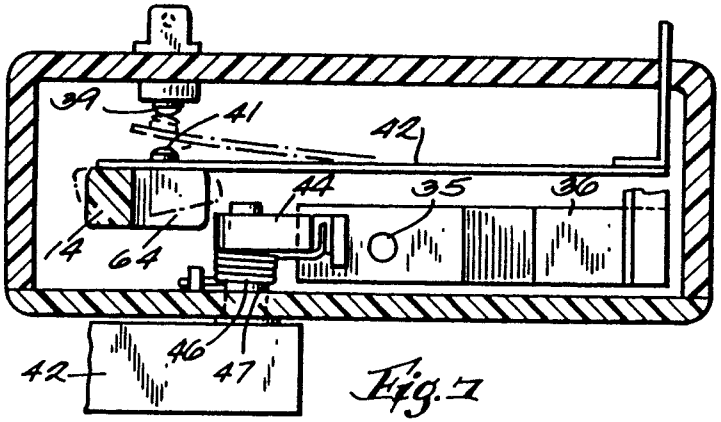
FIG. 7 is a section taken on a line corresponding to 7—7 in FIG. 4.

When the motor current is interrupted, following a sufficient delay, the appliance lid 12 can be opened in which case the lid operated control switch contacts 34 and 35, which are biased closed by blade 36, open due to the action of short arm 44 of lever 48 on the springy blade 36 of the lid switch. As shown in FIGS. 1 and 7 there is a torsion spring 46 surrounding the shaft 47 of the lid switch lever 48. Spring 46 rotates the lid switch operating lever 48 and its short arm 44 clockwise to open the lid switch contacts 34 and 35 when the lid is open so the motor is prevented from running and the dryer basket cannot rotate. Lid controlled switch contacts 34 and 35 close in response to a very small amount of swinging motion by lever 48 which motion results from lid mounted latch element 11 striking it. As is evident in FIG. 4, short arm 44 of lid switch operating lever 48 can swing in a vertical plane through a great arc after contact points 34 and 35 close so that there is little danger of the control lever short arm 44 of the switch lever 48 swinging up against a dead stop. In other words, there is a lot of lost motion or free overtravel permitted because arm 44 of lever 48 can swing until it actually encounters a partition wall 50 in preferably plastic housing 10. Wall 50 allows the electrical contacts to be isolated from other components of the lid lock/switch assembly.

Figure 3:
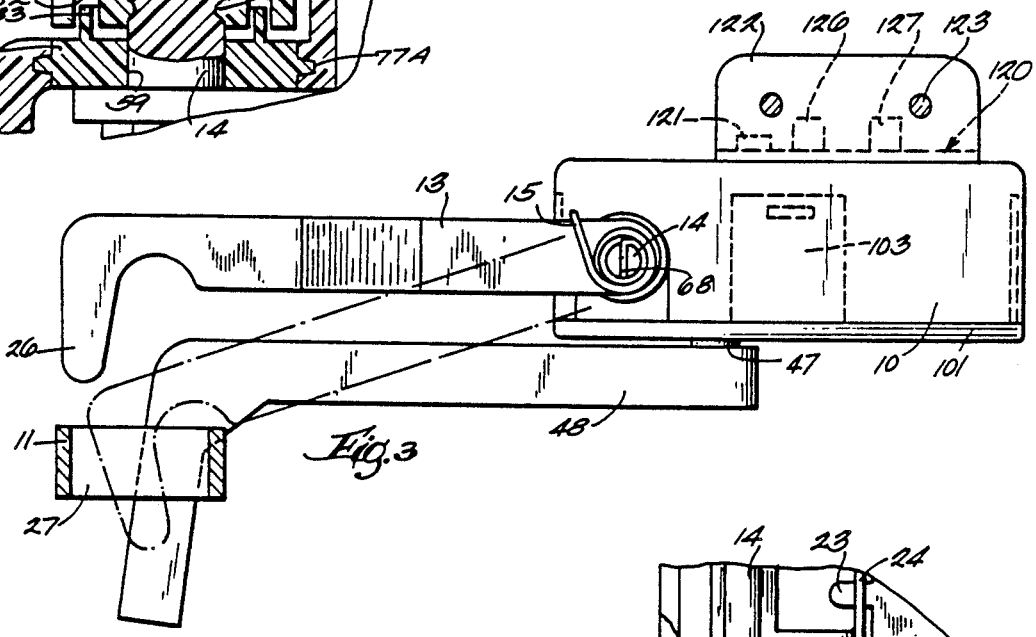
FIG. 3 is a plan view of the switch and lock as viewed in the direction of the line 3—3 in FIG. 2.

The appliance lid operated lever 48 for operating safety or control switch contacts 34 and 35 swings in a vertical plane as shown, that is, it swings orthogonal to the horizontal plane in which the lock lever 13 swings as illustrated in the drawings. As shown in FIG. 3, the tongue or hook 26 on lock lever 13 swings into the side opening 27 of latch element 11 which is mounted to lid 12 with any suitable fasteners such as rivets 56 shown in FIG. 2.

Figure 4:
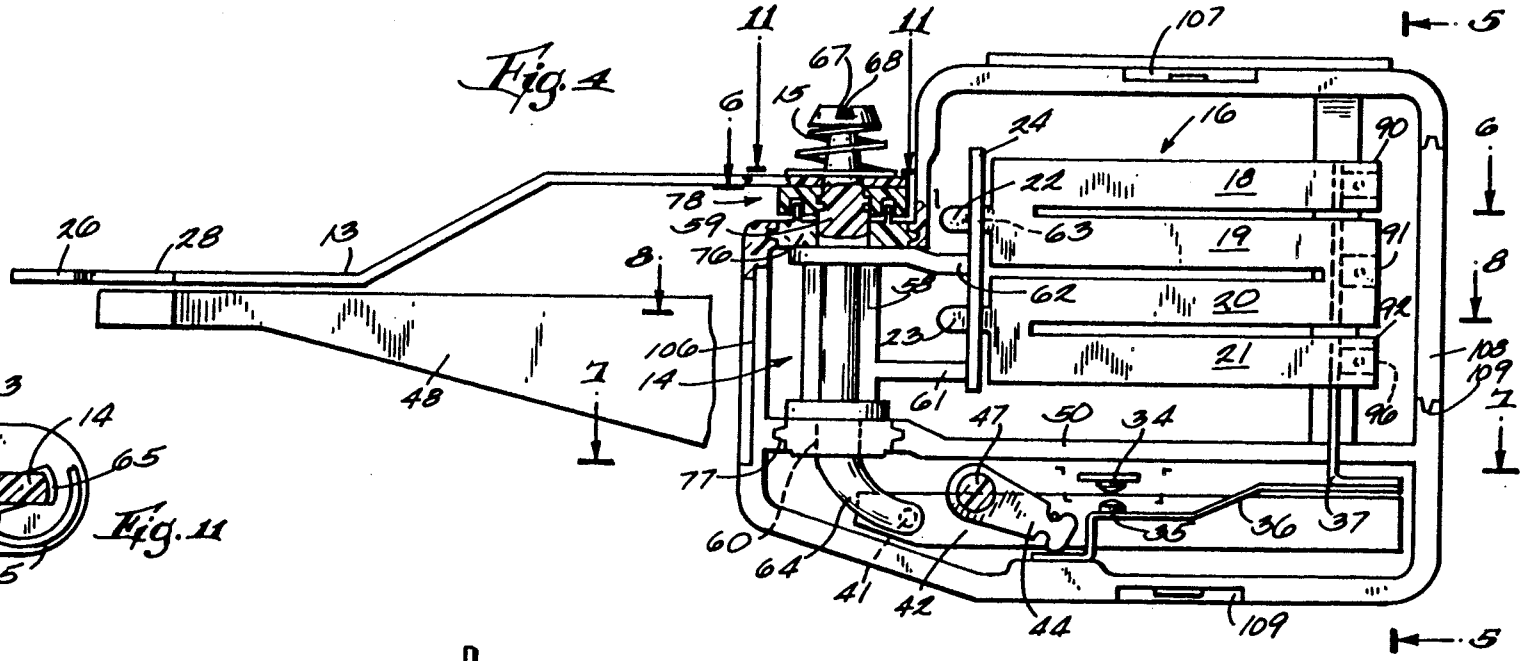
FIG. 4 is a plan view of the switch and lid lock assembly with its cover removed to show the components that are inside of the housing.
Figure 6:
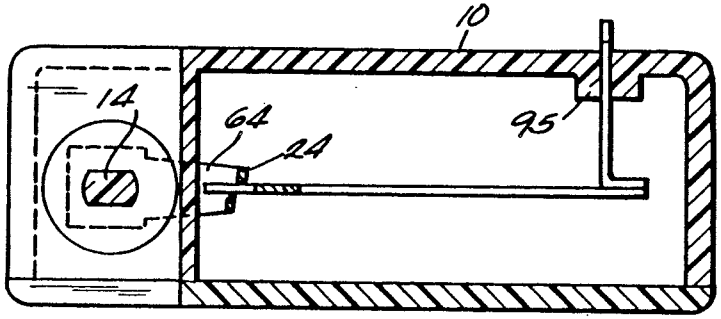
FIG. 6 is a section taken on the irregular line 6—6 in FIG. 4.

Referring to FIG. 4, there is an arcuate cut out 57 in lock lever 13 to permit maximum travel of lever 13 toward latch element 11 before torsion spring 15 is deflected. An alternate construction is to eliminate this cut out causing spring 15 to close with every operation thereby preventing residue from wash water from building up in the cut out 66 and producing unlock time similar to times obtained when the lever 13 is restrained from fully entering hole 27 by misalignment.

As can be seen most clearly in FIG. 4, actuator shaft 14 to which lock lever 13 is fastened has a circular non-cylindrical part 58 and integral oppositely directed cylindrical parts 59 and 60 to allow journaling actuator shaft 14 for rotation. Shaft 14 is composed of a non-conductive material such as plastic. The shaft has two arms 61 and 62 extending radially from it and these arms are formed integrally with cross bar 24 of the actuator. Bar 24 has slots such as the one marked 63 through which the prongs 22 and 23 of the bimetal element 16 extend. In the FIG. 4 embodiment, when the bimetal 16 is heated, its outboard ends having prongs 22 and 23 deflect upward or away from an observer. This deflection causes shaft 14 to rotate so that the outboard hooked end 26 of lock lever 13 swings toward the observer in FIG. 4. This engages the hooked end 26 of the lock lever 13 with the latch loop 11 on the appliance lid 12 and prevents opening of the lid after motor current begins to flow through bimetal 16. As shown in FIGS. 4 and 7, actuator shaft 14 has arm 64 which extends radially oppositely from lock lever 13. Arm 64 is for operating the shunt switch blade 42. Even though the initial deflection of bimetal 16 is sufficient to rotate lock lever 13 to latch the lid, arm 64 on actuator shaft 14 may not have turned sufficiently at that time to close the shunt switch contacts 39 and 41. When the bimetal gets hotter, however, due to conducting motor current for an additional period of time, rotation of arm 64 becomes sufficient to cause movable shunt switch contact 41 on blade 42 to make contact with stationary contact 39 such that motor current will bypass bimetal 16 as previously explained in describing FIG. 1. Shunting the motor current around bimetal 16 causes the bimetal to cool and deflect toward its neutral or unheated position. Then the cyclic closing and opening of the shunt switch contacts 39 and 41 occurs as previously explained.

Figure 10:
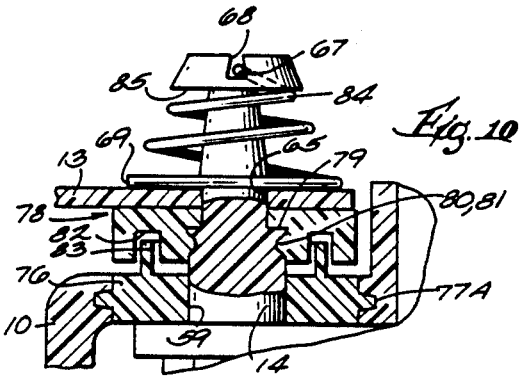
FIG. 10 is a magnified view, partially in section, of the actuator shaft that is rotated by the bimetal element, this view also showing in section the novel manner in which the shaft is sealed against entry of contaminants into the switch housing.
Figure 11:
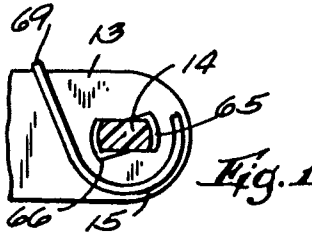
FIG. 11 is a detail of the pivotal end of the lock lever and the actuator shaft showing how lost motion or yieldability is obtained between a shaft and lever.

In accordance with the invention, means are provided for assuring that shunt switch blade 42 will always be operated and that shunt switch contacts 39 and 41 will close even though lock lever 13 may encounter an interference or be blocked against swinging toward or into fully locked position. In other words, means are provided to permit the prong ends of the bimetal 16 to deflect and to operate the shunt switch even though lock lever 13 is blocked. As can be seen most clearly in FIG. 11, actuator shaft 14 has flat sides where it passes through a hole 65 in lock lever 13. Hole 65 has flat diverging sides to provide a free space and, hence, free play for lock lever 13 to rotate relative to shaft 14 and vice-versa. As can be seen in FIGS. 4 and 10, the upper end 67 of the torsion and compression spring 15 is captured in a triangularly shaped slot 68 having an upper gap 68. The inwardly slanted walls of the triangular slot prevent the end 67 of the spring from climbing out of the slot when the spring is loaded torsionally. As shown in FIGS. 10 and 11, the other end 69 of torsion spring 15 is hooked over the edge of lock lever 13. Torsion spring 15 is stressed at all times to hold lock lever 13 in a clockwise biased position on shaft 14. When the bimetal heats and deflects, shaft 14 rotates counterclockwise as viewed in FIG. 11. Now it will be evident that if lock lever 13 is prevented from rotating, the spring will wind up by a small amount but shaft 14 will be able to rotate until it abuts an edge 66 in the lock lever hole 65. By the time the shaft abuts, it has already closed the shunt switch so overheating of the bimetal is prevented. Nevertheless, the shunt switch can open and close cyclically as previously explained so the bimetal will not heat and deflect excessively.

The cylindrical parts 59 and 60 of actuator shaft 14 are journaled in bearing elements 76 and 77. The bearing elements are preferably made of a low friction material such as Acetal. The bearing elements are essentially flat pieces of plastic which have an integral tongue **77*a* formed on them and extending from their edge. One can see most clearly in FIG. 10 that the tongue registers in a complementarily shaped groove in the edges of a slot in the wall of housing body 10. As shown in FIG. 10, the top edge of a typical bearing element is planar and corresponds to the sectioned face which appears in that figure but the bottom end of the element which is not visible is semi-circular to make it easier to slide the tongue into the groove in the edge of the slots that retain them. Were it not for the fact that the bearing elements 76** can be pushed downwardly into the grooves, it would be impossible to assemble the device as can be confirmed by considering the sequence in which the parts must be assembled.

Immediately above bearing element 76 illustrated in FIGURE 10, there is a drip cap 78 of Acetal or other material. This drip cap fits snugly on a shoulder 79 on actuator shaft 14 and protrudes over bearing 76. Actuator shaft 14 also has an annular groove 80 and there is a radially inwardly extending annular ridge 81 in the bore of drip cap 78 so the drip cap can make a snap fit onto the actuator shaft 14. The drip cap 78 rests firmly against a radially extending shoulder 79 on actuator shaft 14 for preventing splash and spray from entering the device along actuator shaft 14. There is an annular barrier 83 extending integrally from the upper face of bearing element 76 in FIG. 10 and this barrier registers in an annular groove 82 to form a labyrinth that is effective to block splash and suds from entering the small clearance between the cylindrical journal part 59 of actuator shaft 15 and the bore of bearing 76. As previously mentioned, spring 15 acts as a torsion spring for biasing lock lever 13 and, as is evident from considering FIG. 10, it also acts as a compression spring for pressing lock lever 13 against drip cap 78. The spring end 67 in the triangularly shaped slot 68 provides rotational coupling with shaft 14 in a manner that prevents the end 67 of the spring from climbing out of the slot when torque is applied by lock lever 13. The smallest diameter convolution 84 of spring 15 is caught and restrained under a shoulder 85 which is formed on actuator shaft 14.

FIG. 8 shows how the prongs 23 on the free end of cantilever mounted bimetal 16 engage with the cross bar 24 that is formed on the ends of the arms 61 and 62 that extend from the actuator shaft 14. In FIG. 8 the phantom lines depict the position of the bimetal when it is heated and the solid lines depict the position of the bimetal when it is cool and in neutral position. FIG. 9 shows an enlargement of the cross section of actuator bar 24 and the slot 63 in it through which the prong 23 at the free end of the bimetal extends. Cross bar 24 is beveled at the margins of slot 63 and these bevels terminate in offset beveled edges 87 and 88. Hence, regardless of the angle which the bimetal prongs make with the actuator bar, the flat prongs always make line contact at the edges 87 and 88 with the bimetal prongs so the binding that would otherwise occur in a conventional unbeveled slot when the angle between the cross bar and the bimetal is very great is avoided.

An important feature of the new lid lock/switch device resides in facilitating correcting for any lack of flatness or straightness in the bimetal element 16 such that the bimetal would not be in the proper neutral position when the device is assembled and the bimetal is cold. Note in FIGS. 4 and 5 that the ends 90, 91, and 92 of the bimetal legs 18-21 are spot welded to conductive posts such as the one marked 94 so the bimetal 16 is supported in cantilever fashion. Typical post 94 is inserted through an upstanding ridge 95 of plastic material that is molded integral with the plastic switch base or housing and which extends from the bottom wall of the housing 10. The posts are swaged as indicated at 97 to preclude withdrawal. The posts have narrow tabs 96 formed integrally with them and at a right angle so the ends of the bimetal legs 18–21 can be spot welded easily to the tabs. The tabs 96 are easily bendable to preposition the bimetal to correct for straightness tolerances and to set the bimetal in neutral position which puts the lock lever 13 in the proper position when the bimetal is cold. This avoids incorporating a separate adjustment means in the device as is common practice in other temperature responsive devices which use bimetals.

The cover for the plastic switch casing or housing 10 is marked 101. The body serves as a base for the various components of the device. The cover snaps in place on the body. For this purpose the cover has four tabs 102–105 which extend at a right angle with respect to the plane of the cover as shown in hidden lines in FIG. 2. There are corresponding recesses 106–109 in the wall of the casing 10. Recesses 106, 107 and 109 do not break through the wall of the housing but rear recess 108 constitutes a window opening to make it convenient to get at the tabs 96 underneath the bimetal so the tabs can be readily accessed for bending as required to compensate for lack of straightness in the bimetal and to establish the bimetal in a predetermined desired neutral position when it is cold. The slot or window 108 in which the tab 104 on the cover registers is provided with tongues 109 which fit into a corresponding groove in the rear wall of the casing 10. Thus, when the cover is in place, bimetal adjusting tab access window 108 is closed.

As shown in FIGS. 2 and 3, the body 10 has one leg 120 of an angle bracket fastened to it with rivets 121. The other leg 122 of the bracket has holes 123 for fastening the switch assembly to the top 124 of the washing machine by means of bolts 125. Two spade connectors 126 and 127 which are for connecting the outside lines to the switch extend through the back of the switch housing 10 below the mounting bracket as shown in FIG. 3.

Figure 12:
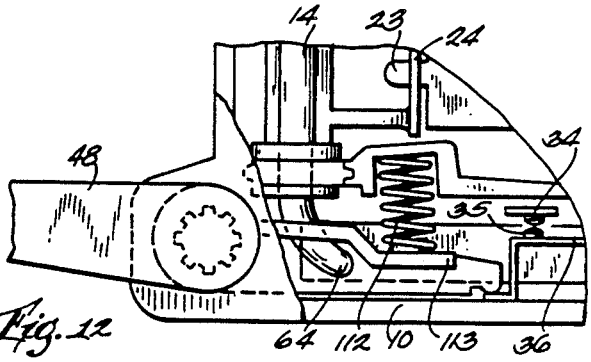
FIG. 12 is an alternative form of the lid switch lever biasing means.

FIG. 12 shows a fragment of the switch for demonstrating use of an alternative type of biasing for the lid switch lever 8 In this embodiment, a coil compression spring 112 is used in place of torsion spring 46 which is depicted in FIGS. 1 and 7 and is used for pre-positioning control switch operating arm 48. Compression spring 112 acts on an arm 113 of control lever 48 to keep control switch contacts 34 and 35 open until the lid on the washing machine is closed. When the lid is closed, the operating lever 48 rotates counterclockwise and only a little bit of motion allows contacts 34 and 35 to close after which there can be lost motion or free overtravel as the compression spring 112 is further compressed by force of the lid on lever 48. Blade 36 is biased in an upward direction closing contacts 34 and 36.

Although several new features in the switch have been described in substantial detail, such description is intended to be illustrative rather than limiting, for the features may be variously embodied and are to be limited only by interpreting the claims which follows.

We claim:

1. A device for locking the closure lid of an appliance such as a washing means in which there is a moving part and an electric motor for driving said part; said device comprising:

a nonconductive base, a bimetal element having prongs extending from one end and means for supporting said element at its opposite end in cantilever fashion on said base, a control switch closable to initiate a closure locking condition and to enable said motor to run, said switch mounted on said base and connected in a series circuit with said bimetal element and said motor so that when said switch is closed electric current conducted through said element heats it and causes said element to deflect in one direction, a pivotally mounted control lever biased to pivot in one direction and pivotable in an opposite direction in response to closing of said closure so as to close said control switch and heat said bimetal element, actuator means including a shaft means and bearing means supporting said shaft means for rotation about its axis relative to said base, arm means extending generally radially from said shaft means and having slot means in which said prongs on said bimetal engage, a lock lever mounted to said shaft means such that the shaft means or said lever has free-play to rotate through a limited angle relative to the other before one begins to drive the other rotationally, a torsion spring having opposite ends connected to said shaft means and lock lever for holding said lock lever in a predetermined angular position while said bimetal is too cool to deflect, deflection of said bimetal in one direction because of said bimetal heating due to flow of said electric current causing said shaft to rotate and transmit driving force by way of said spring to said lock lever for engaging said lock lever with said closure, further deflection of said bimetal allowing further rotation of said shaft until said free-play is taken up even if rotation of said lock lever is obstructed.

2. The device according to claim 1 wherein:

said shaft means has a head formed thereon providing a radially extending shoulder outside of said base and said spring is interposed between said head and said lock lever to apply a compressive force as well as a torsional force to said lever.

3. The device according to claim 2 including:

a drip cap for inhibiting migration of contaminants along said shaft means, said drip cap comprising a disk means having a bore and a radially inwardly extending shoulder in said bore, said shaft means having a shoulder against which said shoulder in said bore of the drip cap is pressed by said spring to effect a movable seal.

4. The device according to claim 2 including:

an annular radially extending lip on a selected one of said bore in the drip cap or said shaft means and a complementarily shaped groove on the other of said bore or said shaft means, said drip cap being made of a material that is sufficiently resilient for said lip to be forced over said shaft to register in said groove.

5. The device according to any one of claims 2, 3 or 4 wherein said head on said shaft means has a slot in which said one end of the combination torsion and compression spring resides, said slot originating from a small gap for said end to fit into said slot and said slot being generally triangular with diverging opposite sides and a bottom forming corners with the sides into which corners said end is engaged to prevent said end from exiting through said gap when said spring is torsionally stressed.

6. The device according to any one of claims 3 or 4 including:

a wall on said base, said wall having a slot opening to an edge of the wall, said bearing means comprising an element mounted in said slot for journaling said shaft means, said bearing element having generally parallel opposite faces and a nominally top edge, a curved edge opposite of said top edge and side edges, said curved and side edges having a tongue and said slot having a corresponding groove in which the tongue registers for installing and securing said bearing element.

7. The device according to claim 1 including a drip cap for inhibiting migration of contaminants along said shaft means, said drip cap comprising a disk means having a bore and a radially inwardly extending shoulder in said bore, said shaft having a shoulder on which said shoulder in said bore bears to effect a movable seal.

8. The device according to claim 6 wherein said bearing element has an annular rib projecting in the axial direction from a fad thereof and said drip cap has a corresponding annular channel in which said rib is registered with clearance between said channel and rib.

9. The device according to claim 1 wherein:

said means for supporting said bimetal element comprises metallic post means to which said bimetal is fastened to effect said cantilever support, said post means being bendable to establish said bimetal element when it is unheated in an initial desired undeflected condition to compensate for manufacturing tolerances in said element.

10. The device according to claim 1 wherein said bearing means for said shaft means comprises a nominally flat bearing element having opposite parallel planar surfaces surrounded by its edges, said element having a shaft journaling hole whose axis is substantially perpendicular to said surfaces and a tongue projecting outwardly away from said edges about a major part of the perimeter of said flat element, said base having a slot whose inside edges contain a groove complementarily shaped to the tongue for the element to be slid into said slot to support said shaft.

11. The device according to claim 10 wherein said shaft of said actuator means has a part at one end that is tapered in an axial direction and is noncircular on opposite sides for a noncircular hole in said lock lever to fit over said part to effect a driving connection between said part of said shaft and said lock lever, the smaller diameter end of said tapered part having a shoulder formed on it and said end having a spring retaining groove, said bearing element having an annular axially extending lip formed on one planar surface and faced toward said tapered part, a drip seal having a hole for fitting over said tapered part and a flat surface on one side and a circular recess having a larger diameter than said lip on the other side for allowing nesting of said lip over said recess to effect drip seal, a wire coil spring having convolutions increasing in diameter spirally from one end to the other, the larger diameter end convolutions fitting over said tapered part with substantial clearance and the largest diameter convolution bearing on said lock lever to yieldably position said lock lever, the smaller diameter end of said spring being expandable to fit over said smaller diameter end of said tapered part and then contract under said shoulder for said shoulder to retain said spring in a precompressed condition.

12. The device according to claim 1 wherein said slots on said arm means into which said bimetal prongs extend are defined by opposite edges on each side of said slots beveled in opposite directions and slightly displaced from each other in a direction along said prongs so that said prongs can fit through the space between said edges and said edges will make substantially line contact with said prongs when said bimetal is deflected as well as when said bimetal is undeflected.

13. The device according to claim 1 wherein:

said control switch comprises a stationary contact element and a movable contact element, a flat conductive resilient blade on which said movable contact element is mounted and which is supported in cantilever fashion relative to said base, the resiliency of said blade causing said blade to establish contact between said movable contact element and stationary contact element, said control lever having an arm for bearing on said blade under the influence of said bias to positively separate said contact elements when said lid is not fully closed, said contacts being arranged such that they close in response to slight pivotal movement of said arm in opposition to said bias and said arm being proportioned so it can overtravel by a substantial amount after it has let said contacts close.

14. The device according to claim 1 including:

a shunting switch on said base in a circuit connected in shunt with said bimetal element closable to bypass current around said bimetal element, said arm means of said actuator means also causing said shunting switch to close when said lock lever is in locking position in response to said bimetal element deflecting a predetermined amount in said one direction, closure of said shunting switch causing said bimetal to be bypassed and to cool and deflect oppositely of said one direction so as to swing said arm means sufficiently to reclose said shunting switch without swinging said lock lever out of locking position.

15. An electroresponsive appliance locking device comprising:

a base, a bimetal element having prongs extending from one end and means for supporting said element at its opposite end in cantilever fashion on said base, a control switch closable to initiate a locking condition, said switch mounted on said base and connected in a series circuit with said bimetal element so that when said switch is closed electric current conducted through said element heats it and causes said element to deflect in one direction, a pivotally mounted control lever biased to pivot in one direction and pivotable in an opposite direction to close said control switch and heat said bimetal element, actuator means for being driven by deflections of said bimetal element and including shaft means and bearing means supporting said shaft means for rotation about is axis relative to said base, said bearing means comprising a bearing element having opposite parallel planar surfaces surrounded by the edges of said element and a hole in said bearing element for journaling said shaft, an annular lip concentric to said hole and projecting from one of said bearing element surfaces axially of said hole, a drip ring having a hole for fitting over said shaft means in interfacing relation to said bearing element and said disk having a circular recess for allowing nesting of said lip in said recess to effect a drip seal, a lock lever connected with said shaft means for rotation therewith in one direction to effect a locked condition in response to deflection of said bimetal due to heating and in the opposite direction to effect an unlocked condition due to cooling of said bimetal element, and a combination wire wound torsion and compression spring means having one end engaged with said shaft means and the other end engaged with said lock lever to apply a torsional force to said lever and said spring means being interposed between said shaft and lever to yieldably determine the position of the lock lever so that when the lock lever is stressed by lifting said lid it will deflect against the underside of the top of said appliance.

16. The locking device according to claim 15 wherein there is a tongue projecting from the edge of said bearing element along a major part of the perimeter of said element and there is a slot in said base in whose edge there is a groove shaped complementarily with said tongue for allowing said bearing element to be inserted to support said shaft means of said actuator means for rotation.

17. An electroresponsive appliance locking device comprising:

a base, a bimetal element having prongs extending from one end and means for supporting said element at its opposite end in cantilever fashion on said base, a control switch closable to initiate a locking condition, said switch mounted on said base and connected in a series circuit with said bimetal element so that when said switch is closed electric current conducted through said element heats it and causes said element to deflect in one direction, a pivotally mounted control lever biased to pivot in one direction and pivotable in an opposite direction to close said control switch and heat said bimetal element, actuator means for being driven by deflections of said bimetal element and including shaft means and bearing means supporting said shaft means for rotation about is axis relative to said base, a lock lever connected with said shaft means and swingable between a neutral position and a locking position, said means for supporting said bimetal element at its said opposite end comprises metallic post means to which said bimetal is fastened to effect said cantilever support, said post means being bendable to establish said bimetal element when it is unheated in an initial desired undeflected condition to compensate for manufacturing tolerances in said element and wherein said base has a chamber defined by walls in which there is an opening adjacent said point means to facilitate access for bending said post means, opposite edges of said opening having a groove, a cover having a partial wall with parallel edges and an integral tongue projecting from each edge for enabling said tongue to slide into said groove to close said opening.

* * * * *

UNITED STATES PATENT AND TRADEMARK OFFICE

CERTIFICATE OF CORRECTION

PATENT NO. : 4,995,650

DATED : February 26, 1991

INVENTOR(S) : Spencer Schantz, Ronald J. Janz, Gary Christiansen and Steven Sager It is certified that error appears in the above-identified patent and that said Letters Patent is hereby corrected as shown below:

Column 12, Line 46:

Delete "connected with" and substitute --- mounted at one end to --.

Column 12, Line 53:

Delete "point" and substitute --- post ---.

Signed and Sealed this

Twenty-eighth Day of July, 1992

*Attest:*

DOUGLAS B. COMER

*Attesting Officer*

*Acting Commissioner of Patents and Trademarks*